United States Patent [19]

Smale

[11] 4,302,149

[45] Nov. 24, 1981

[54] CERAMIC VANE DRIVE JOINT

[75] Inventor: Charles H. Smale, Indianapolis, Ind.

[73] Assignee: General Motors Corporation, Detroit, Mich.

[21] Appl. No.: 122,475

[22] Filed: Feb. 19, 1980

[51] Int. Cl.[3] ..... F01D 17/16

[52] U.S. Cl. ..... 415/134; 403/30; 415/160; 415/164

[58] Field of Search ..... 415/134, 163, 164, 200, 415/160, 165, 161, 162; 403/28, 29, 30

[56] References Cited

U.S. PATENT DOCUMENTS

| | | | |
|---|---|---|---|
| 2,809,803 | 10/1957 | Featonby | 415/134 X |
| 2,996,279 | 8/1961 | Lorett et al. | 415/134 X |
| 3,392,958 | 7/1968 | Penny et al. | 415/160 |
| 3,910,716 | 10/1975 | Roughgarden et al. | 415/200 |
| 3,981,140 | 9/1976 | Lunsford et al. | 60/39.03 |

*Primary Examiner*—Leonard E. Smith
*Attorney, Agent, or Firm*—J. C. Evans

[57] ABSTRACT

A variable geometry gas turbine has an array of ceramic composition vanes positioned by an actuating ring coupled through a plurality of circumferentially spaced turbine vane levers to the outer end of a metallic vane drive shaft at each of the ceramic vanes. Each of the ceramic vanes has an end slot of bow tie configuration including flared end segments and a center slot therebetween. Each of the vane drive shafts has a cross head with ends thereof spaced with respect to the sides of the end slot to define clearance for free expansion of the cross head with respect to the vane and the cross head being configured to uniformly distribute drive loads across bearing surfaces of the vane slot.

1 Claim, 4 Drawing Figures

CERAMIC VANE DRIVE JOINT

The invention described herein was made in the performance of work under a NASA contract funded by the Department of Energy of the United States Government.

CERAMIC VANE DRIVE JOINT

This invention relates to variable setting vane structures for use in turbomachines and more particularly to variable setting vane cascades having ceramic composition vanes driven from a common actuating ring through metallic turbine vane lever and metallic turbine shaft components.

Various proposals have been suggested for driving variable setting vane cascades for compressors and other turbomachines. Examples of such arrangements are set forth in U.S. Pat. Nos. 3,788,763, issued Jan. 29, 1974, to Nickles, for "Variable Vanes" and 3,981,140, issued Sept. 21, 1976, to Lunsford et al, for "Gas Turbine Engine Geometry Control."

In such arrangements all of the component parts of the drive system and the vane components of the variable geometry are of metallic composition.

Advance gas turbine engine systems, however, are operating at temperature levels at which it is desirable to consider the use of ceramic composition material for the variably set hot gas exposed vanes of the variable geometry assemblies. An example of such variable geometry ceramic composition vanes is set forth in U.S. Pat. No. 3,392,958, issued July 16, 1968, to Penny et al, for "Adjustable Nozzle Guide Vane Assembly For An Axial Flow Turbine."

While the aforesaid variable setting vanes are suitable for their intended purpose, they require all metal parts or all ceramic parts to accomplish the adjustment of the parts with respect to a high temperature gas stream flowing across the vane components of the variable setting vane cascade assemblies.

Accordingly, an object of the present invention is to provide an improved variable geometry, mechanical design for driving vanes of ceramic composition in a cascade array of variable setting vanes through a drive system including components having a thermal expansion differing from that of the vanes and to do so by the provision of a vane-to-drive shaft joint including means to accommodate differences in thermal expansion of the vane and a drive shaft connected thereto and means to uniformly distribute drive loads across internal joint surfaces formed between the drive shaft and the vane.

Another object of the present invention is to provide an improved drive system for transferring drive force from a turbine vane actuating ring to a cascade of variable setting ceramic turbine vanes by the provision of means defining a configured vane joint that includes a bow tie configured slot in the end of a ceramic vane and a cross head of a metal drive shaft located in the slot including flared ends thereon partly congruent with the surface configuration of the bow tie configured vane slot and operative to define a substantially extended load transfer surface while including clearance spaces between the cross head and the vane so that the cross head of the metal shaft is free to expand with respect to the ceramic vane thereby to accommodate relative differential expansion between the vane and drive shaft of the joint.

Further objects and advantages of the present invention will be apparent from the following description, reference being had to the accompanying drawings wherein a preferred embodiment of the present invention is clearly shown.

Figure 1:
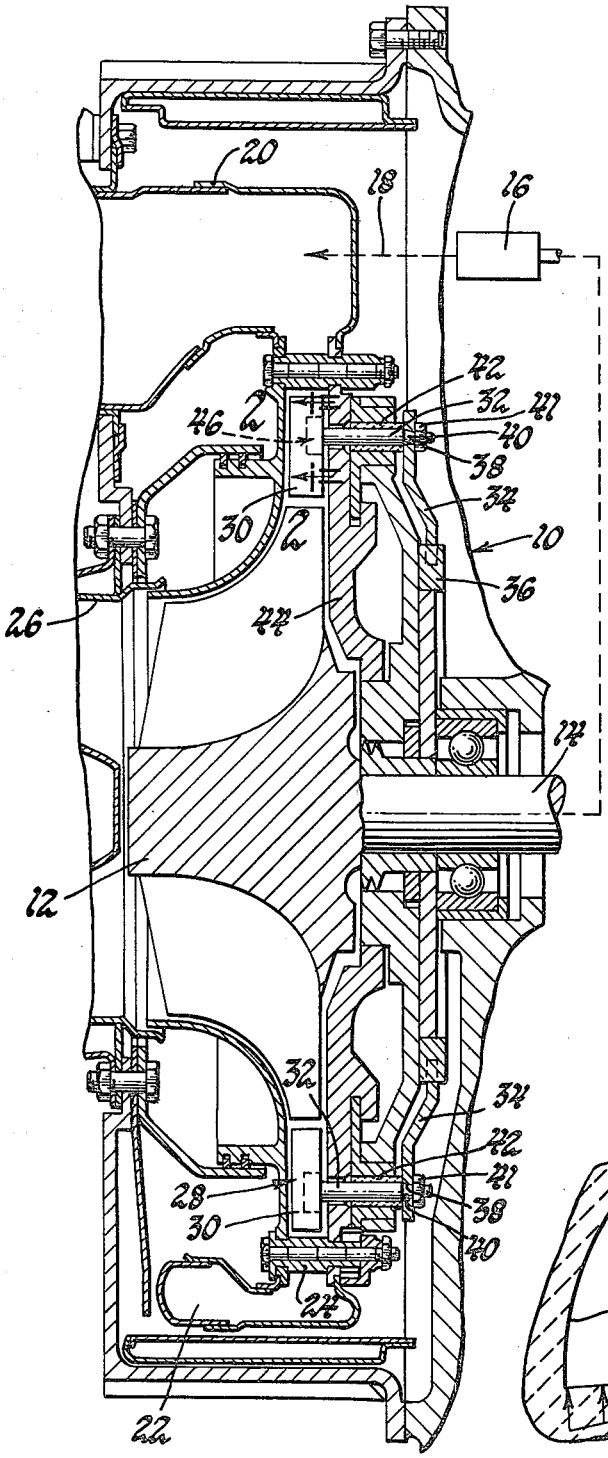
FIG. 1 is a view in longitudinal section of a gas turbine having a cascade of variable setting vanes therein joined to a turbine vane actuating system by a ceramic-to-metal joint in accordance with the present invention.
Figure 2:
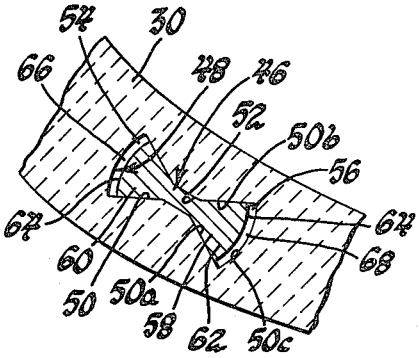
FIG. 2 is an enlarged vertical sectional view taken along the line 2—2 of FIG. 1.
Figure 3:
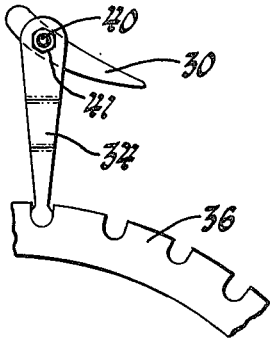
FIG. 3 is a fragmentary end view of the drive train between the turbine vane actuating ring and turbine vane at one of the variable setting vanes of the cascade of vanes shown in FIG. 1.

Referring to FIG. 1, a gas turbine section 10 of a gas turbine engine is illustrated. It includes a turbine rotor 12 having a drive shaft 14 thereon coupled to a compressor 16 diagrammatically illustrated in FIG. 1. The compressor 16 is operative to discharge high pressure air through a gas path 18 to a fuel air combustor 20, partially shown in FIG. 1. Motive fluid from the combustor 20 is directed through a turbine inlet plenum 22 to a turbine nozzle 24 that discharges gas from the inlet plenum 22 tangentially and radially into the periphery of the turbine rotor 12, from which it is discharged axially into a turbine exhaust passage 26.

The turbine nozzle 24 includes a cascade 28 of variable setting vanes 30 concurrently rotatable about their individual axes parallel to the axis of drive shaft 14 thereby to vary the area of the turbine nozzle and the characteristics of flow into the turbine rotor 12.

In accordance with certain principles of the present invention, each of the vanes 30 is fabricated from a high temperature resistance ceramic material such as a reaction sintered silicon carbide or reaction sintered silicon nitride material. Such materials are capable of operating in turbine inlet temperature conditions in the range of 1000° C. to 120° C. In accordance with the present invention, each of the vanes 30 is supported from a shaft 32 and is individually actuated by a drive lever 34. The vane drive levers 34 are oriented in a nearly radial direction so that differential thermal expansion with respect to radially inwardly located actuating ring 36 will not induce deviations in the angular setting of the individual ones of the variable setting vanes 30. Each of the vane lever arms 34 is lanced to define a tapered flat sided opening 38 that mates with a threaded outboard end 40 of the vane shafts 32 to provide an interference fit therebetween. A nut 41 secures the threaded end 40 to each lever arm 34. A ceramic bushing 42 supportingly receives the outer surface of the shaft 32 outboard of the back plate 44 of the gas turbine section 10 to produce a reduced coefficient friction at elevated temperatures to facilitate adjustment of each of the individual vanes 30 into a variable setting angular relationship as dictated by a gas turbine engine control schedule of the type more specifically set forth in the above-identified Lunsford et al. U.S. Pat. No. 3,981,140.

Each of the drive shafts 32 is fabricated from metal material with a substantial differential thermal growth with respect to the ceramic material of the vanes 30. Thus, in accordance with the present invention, an improved vane shaft joint 46 is utilized to mount the inboard end of each of the vane shafts 32 to the shaft. The improved joint 46 accommodates the extreme differential thermal growth between the material of the mating components without affecting the fit therebetween and without imposing excessive stress in the ceramic material of each of the vanes 30. To accomplish this objective, each of the vanes 30 has a bow tie configured end slot 48 therein including a continuously formed wall surface 50 defining a reduced width center slot 52 of generally rectangular configuration which merges with two spaced tapered end slots 54, 56 defined by extended side surfaces 50*a*, 50*b* diverging outwardly of slots 52 and joined by a curved cross segment 50*c*. Each of the metal shafts 32 includes a cross head 58 thereon with flared ends 60, 62 that are congruent with the wall segments 50*a*, 50*b* and each including a curved end surface 64 spaced from the wall segment 50 to define a clearance space 66, 68 between the vane 30 and the connecting cross head 58.

Figure 4:
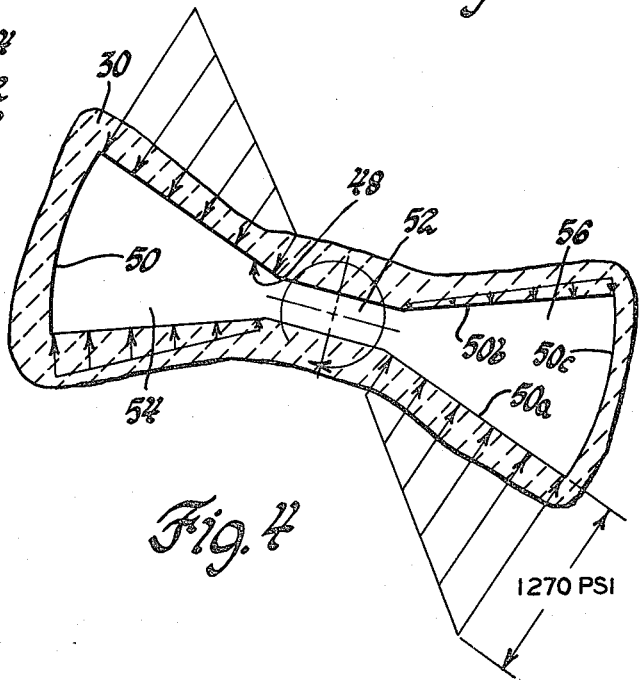
FIG. 4 is a diagrammatic view of a load distribution chart showing the load distribution between a cross head of a drive shaft and the driven vane of the present invention.

The contact between the flared ends 60, 62 of the cross head 58 and the segments 50*a*, 50*b* of the wall 50 is extended to attenuate drive loadings thereby to produce a low load distribution pattern of the type shown in FIG. 4 on the walls of slot 48 which is well within the load carrying capabilities of typical ceramic compositions. In one working embodiment the maximum unit loading is 1270 PSI for a drive torque of 6.2 inch pounds at the joint between the shaft cross head 58 and the vane 30.

More particularly, because of the configuration of the bow tie slot and the cross head 58, the flared ends 60, 62 are free to expand with respect to each vane 30 by a distance represented by the clearance spaces 66, 68 sized to accommodate the extremes of differential thermal growth between the vane when at the temperature of the motive fluid through the nozzle 24, and the cooler operating drive components which are outboard of the back plate 44. The depth of the bow tie in slot 48 is limited to only part of the depth of the vane 30 so that the length of the shaft 32 exposed to high temperature gas is limited. Moreover, the vane shaft 32 is cooled by conductive heat transfer produced by leakage flow from the lever end of the shaft to the vane end thereof.

Accordingly, the above-illustrated arrangement accommodates substantial relative thermal growth between a metal drive shaft and a ceramic vane while preventing excessive stress build-ups in the vane during the operation of the turbine at elevated temperature conditions. Moreover, it prevents the development of excessive play between the component parts of the variable setting vanes and the cooler operating metal drive components since the bow tie configuration enables the wall segments 50*a*, 50*b* to be maintained in contact with the flared ends 60, 62 while growth clearance is provided by the spaces 66, 68.

While the embodiments of the present invention, as herein disclosed, constitute a preferred form, it is to be understood that other forms might be adopted.

The embodiments of the invention in which an exclusive property or privilege is claimed are defined as follows:

1. In a drive system for transfer of drive force from a turbine vane actuating ring to a ring of ceramic turbine vanes via plurality of turbine vane levers each coupled at one end to the ring and at an opposite end to a metal drive shaft, the improvement comprising: means for defining a bow tie configured vane end slot in each of said ceramic vanes, each of said slots having a wall with reduced width center segments and extended side surfaces diverging outwardly from said center segments to form tapered end slots, a cross head on each of said metal drive shafts with flared ends thereon fit in said end slots to engage said side surfaces for distributing a vane drive force across the extended side surfaces so as to attenuate drive force produced loads on said ceramic vane, said flared ends having a length less than that of said end slots to define clearance spaces to accommodate relative thermal growth between the metal of said drive shaft and the ceramic of said vane so as to prevent excessive stress in said vane during operation of the turbine at elevated temperature conditions.

* * * * *